US009068723B2

(12) United States Patent
Wilkinson et al.

(10) Patent No.: US 9,068,723 B2
(45) Date of Patent: Jun. 30, 2015

(54) CONFIGURABLE LAMP ASSEMBLY

(71) Applicants: Dean Andrew Wilkinson, Boise, ID (US); Nathan Howard Calvin, Boise, ID (US)

(72) Inventors: Dean Andrew Wilkinson, Boise, ID (US); Nathan Howard Calvin, Boise, ID (US)

( * ) Notice: Subject to any disclaimer, the term of this patent is extended or adjusted under 35 U.S.C. 154(b) by 145 days.

(21) Appl. No.: 13/844,007

(22) Filed: Mar. 15, 2013

(65) Prior Publication Data

US 2014/0268854 A1 Sep. 18, 2014

(51) Int. Cl.
*F21V 13/04* (2006.01)
*F21S 8/10* (2006.01)

(52) U.S. Cl.
CPC ..... *F21V 13/04* (2013.01); *F21S 48/33* (2013.01); *Y10T 29/49002* (2015.01); *F21S 48/215* (2013.01); *F21S 48/22* (2013.01); *F21S 48/2206* (2013.01); *F21S 48/321* (2013.01); *F21S 48/328* (2013.01); *F21S 48/337* (2013.01)

(58) Field of Classification Search
CPC ..... F21V 13/04; F21S 48/215; F21S 48/22; F21S 48/2206; F21S 48/321; F21S 48/337; Y10T 23/48002
USPC ..... 362/507, 520, 267
See application file for complete search history.

(56) References Cited

U.S. PATENT DOCUMENTS

| | | | | |
|---|---|---|---|---|
| 4,755,917 | A * | 7/1988 | Bals et al. | 362/547 |
| 4,796,163 | A * | 1/1989 | Dressler | 362/547 |
| 4,802,068 | A * | 1/1989 | Mokry | 362/547 |
| 5,249,112 | A | 9/1993 | Bray | |
| 6,191,541 | B1 | 2/2001 | Patel et al. | |
| 6,210,014 | B1 * | 4/2001 | Kubizne et al. | 362/96 |
| 6,250,787 | B1 * | 6/2001 | Matubara | 362/520 |
| 6,267,491 | B1 * | 7/2001 | Parrigin | 362/546 |
| 6,357,902 | B1 | 3/2002 | Horowitz | |
| 6,398,396 | B1 * | 6/2002 | Nestell et al. | 362/520 |
| 6,454,449 | B2 * | 9/2002 | Nestell et al. | 362/520 |
| 6,533,445 | B1 | 3/2003 | Rogers | |
| 6,811,287 | B2 | 11/2004 | Roller et al. | |
| 6,997,583 | B2 | 2/2006 | Broelemann | |
| 7,686,486 | B2 * | 3/2010 | Tessnow et al. | 362/487 |
| 7,726,837 | B2 | 6/2010 | Ewert | |
| 7,758,203 | B2 | 7/2010 | McMahon et al. | |
| 7,772,988 | B1 * | 8/2010 | Condon et al. | 340/815.45 |
| 7,806,575 | B2 | 10/2010 | Willwohl et al. | |
| 8,007,155 | B2 * | 8/2011 | Bolander et al. | 362/545 |
| 8,060,168 | B2 | 11/2011 | Horrdin et al. | |
| 8,087,807 | B2 | 1/2012 | Liu et al. | |
| 8,172,425 | B2 | 5/2012 | Wen et al. | |
| 8,344,871 | B2 * | 1/2013 | McLoughlin et al. | 340/469 |
| 2013/0051009 | A1 | 2/2013 | Zaderej et al. | |

* cited by examiner

*Primary Examiner* — John A Ward
(74) *Attorney, Agent, or Firm* — Gerard Carlson

(57) ABSTRACT

A configurable lamp assembly has a set of lamp-lens modules and a set of power modules. Each of the various lamp-lens modules can connect to one of the various power modules to provide a variety of lamp assemblies providing various illumination patterns operable from a number of supply voltages.

19 Claims, 10 Drawing Sheets

CONFIGURABLE LAMP ASSEMBLY

CROSS REFERENCE TO RELATED APPLICATIONS

This application is related to design patent application entitled "Lighting Fixture", application Ser. No. 29/427,741 filed on Jul. 21, 2012 by Calvin and Wilkinson.

FEDERALLY SPONSORED RESEARCH OR DEVELOPMENT

Not applicable.

JOINT RESEARCH AGREEMENT

Not applicable

SEQUENCE LISTING

Not applicable

FIELD OF THE INVENTION

The present invention relates to the field of lamp assemblies, and in particular to lamp assemblies for aircraft and vehicles.

BACKGROUND OF THE INVENTION

Currently, for aircraft and vehicle lighting, there are various voltages and light emission types and patterns required depending upon application. Lamp assemblies may also be required to operate in hazardous environments.

Designers and installers of lamp assemblies are required to specify, stock, supply, and install many different lamp assembly types in order to achieve the required illumination spectrum, pattern and voltage.

SUMMARY OF THE INVENTION

The configurable lamp assembly has a set of lamp-lens modules and a set of power modules. Each of the various lamp-lens modules can connect to one of the various power modules to provide a variety of lamp assemblies providing various output spectrums, and illumination patterns, operable from a number of power supply frequencies and voltages.

In one embodiment a lamp-lens module and a power-module fit together to form a configurable lamp assembly. The lamp-lens module has a first side with a lens and one or more lamps while the second side has a lamp PCA connector; and is configured to join with the power module. A lamp PCA connector is on the second side and connects to a power module connector on the power module thus supplying power to the lamp-lens module. In this disclosure "PCA" refers to "printed circuit assembly".

The power module has a first side exposing the power module connector which is adapted to connect with the lamp-lens module lamp PCA connector. The second side of the power module has an external connector which receives electrical power and control signals from an external source. A gasket fits between the lamp-lens second side and power module first side, the gasket seals the lamp-lens module and the power module together forming a common-internal-environment. This seal forms a hermetically sealed cavity of the lamp-lens and the power module. An external-port connects the common internal environment with an external ambient environment. A moisture-barrier and vent permit gaseous communication between the common internal environment, and the outside ambient environment while preventing liquid exchange.

A removable fastener system holds the lamp-lens module together with the power module, capturing the gasket between the lamp-lens module and the power module. The removable fastener system enables interchangeability of the lamp-lens module with the power module. This interchangeability enables different types of lamp-lens modules to be connected to different types of power modules. Thus several combinations of lamp-lens modules and power modules are possible to accommodate different power sources and illumination requirements.

In other embodiments, the configurable lamp assembly has an inter-module thermal-medium between the lamp-lens module second side and the power module first side to conduct heat from the lamp-lens module to the power module. In this embodiment, the power module is designed to dissipate heat and reduce the temperature of the lamp-lens module. The inter-module thermal-medium can further act to seal the common internal environment from the external ambient environment.

Other embodiments of the configurable lamp-lens module have a plurality of lamps. Some lamps emit visible light, while other lamps emit infrared light. Lamp-lens modules can emit either visible, infrared or both types of light as well as other spectrums. Depending upon application, a lamp-lens module may emit one selected spectrum or selectively emit different spectrums upon command from an external source.

In another embodiment, the power module is characterized by a heat sink. This heat sink is sturdy enough to accommodate a hard point on the power module for mounting the configurable lighting assembly to vehicles. Different types of mounting assemblies can use this hard point to attach the power-module, and thus the entire configurable lamp assembly to a vehicle.

Some embodiments of the lamp-lens module project a spot light beam, while other embodiments of the lamp-lens module project a flood light beam. Still other embodiments of the lamp-lens module can be designed to project beams meeting specific dispersion requirements and profiles.

Yet other embodiments have a spark arrestor in or at the external port. The spark arrestor allows the configurable lamp assembly to be used in a hazardous environment where there is a danger of an explosive atmosphere. In such cases, any spark or possible ignition source is quenched before it can exit the common internal environment of the configurable lamp assembly. This feature enables the configurable lamp assembly to be used in environments requiring explosion proof fixtures.

In one embodiment the lamp-lens module has a lamp housing, and one or more lamps mounted on a lamp PCA. The lamp PCA fits into the lamp housing and a lamp PCA thermal medium between the lamp PCA and the lamp housing transfers heat from the lamp PCA to the lamp housing. A lens fits to the lamp housing and permits light from the lamp to exit the first side of the lamp-lens module. The lamp housing opposite the lens is the second side of the lamp-lens module that connects to the power module with a lamp PCA connector.

In another embodiment, the power-module has a power module heat sink. The power module heat sink has a first side with a power module PCA attached to the power module heat sink first side. A power-module-connector attaches to the power module PCA. The power module connector is exposed on the power module heat sink first side so that it can connect with the lamp PCA connector. An external connector connects to the power module PCA, and is exposed on the power module heat sink second side.

An external port connects the power module heat sink first side and second side. The power module first side further receives the lamp-lens module second side enabling a gaseous seal between the lamp-lens module and the power module and the connection of the lamp PCA connector to the power module connector.

This gaseous seal is accomplished with a gasket adapted to fit between the lamp-lens second side and power module first side. The gasket enables a common-internal-environment between the lamp-lens module and the power module. A moisture barrier vent in the external port of the power module heat sink permits gaseous communication between the common internal environment, and an external ambient environment while preventing liquid exchange.

A removable fastener system holds the lamp-lens module together with the power module, capturing the gasket between the lamp-lens module and the power module. The removable fastener system enables a variety of lamp-lens modules to attach to a variety of power modules. The removable fastener system also enables replacement of a failed module and reuse of a good module.

The method of constructing a configurable lamp assembly involves providing a selection of lamp-lens modules, each lamp-lens module configured to produce a selected light emission pattern and a selected spectral emission range. Then providing a selection of power modules, each power module adapted to a selected range of power inputs. By remove-ably interfacing together any one of the selection of lamp-lens modules with any one of the selection of power modules a user can form a configured lamp assembly. When this interface includes a gasket or seal, an internal environment is formed. Electrical connections between the two modules allows the transmitting of electrical power and control from the power module to the lamp-lens assembly. Venting gasses between internal environment and an external ambient environment is accomplished with an external port. Blocking the passage of liquids between the internal environment and the external ambient environment is enabled with a moisture barrier. Arresting sparks from passing from the internal environment to the external environment enables use in hazardous environments.

BRIEF DESCRIPTION OF DRAWINGS

The summary above, and the following detailed description will be better understood in view of the enclosed drawings which depict details of preferred embodiments. Like reference numbers designate like elements. It should however be noted that the invention is not limited to the precise arrangement shown in the drawings. The features, functions and advantages can be achieved independently in various embodiments of the claimed invention or may be combined in yet other embodiments.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modification to the various disclosed embodiments may be made and other embodiments may be utilized, without departing from the spirit and scope of the present invention. The following detailed description is therefore, not to be taken in a limiting sense.

Figure 1:
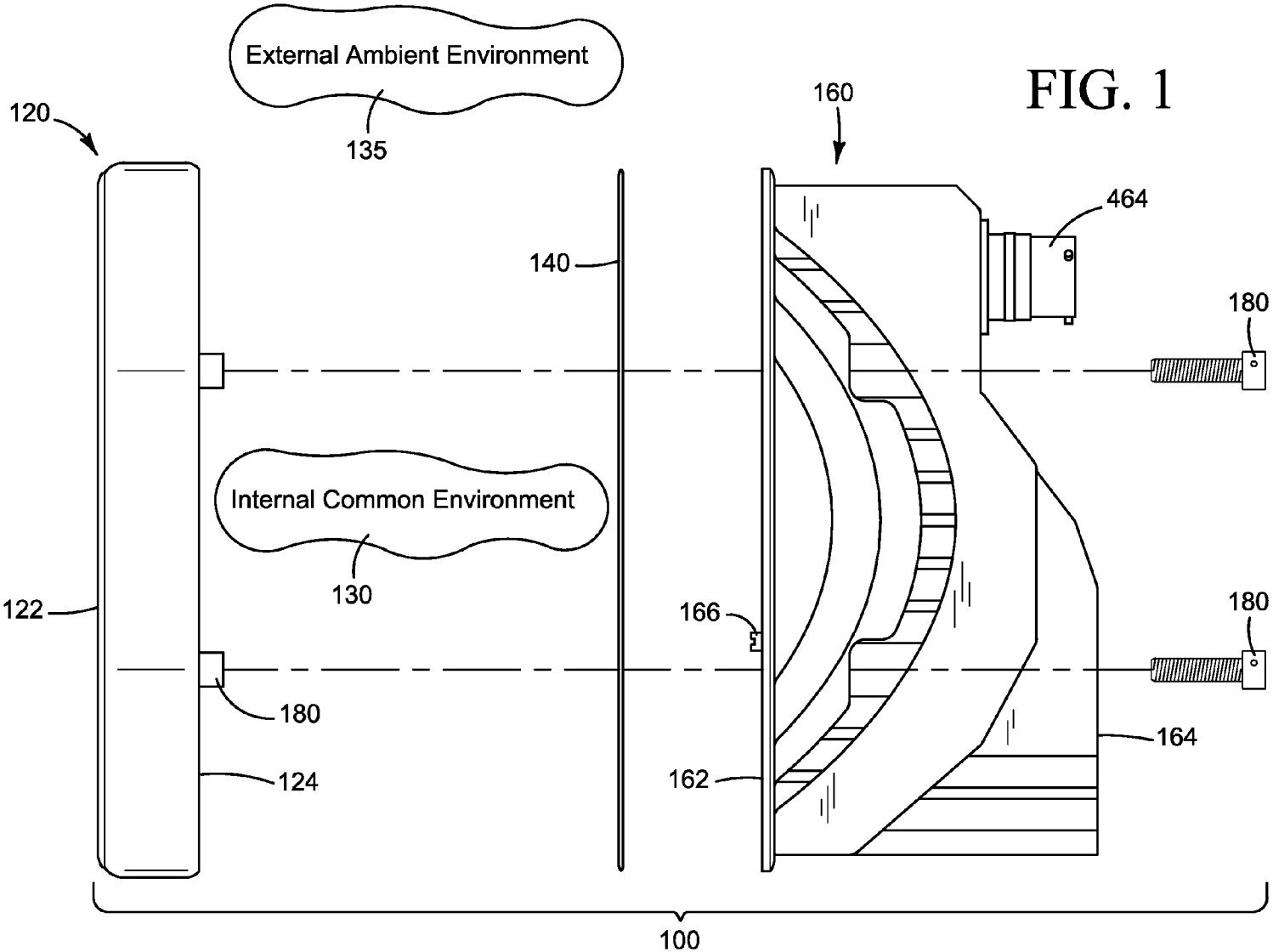
FIG. 1 shows of an exploded view of an embodiment the lamp-lens module and the power module.

FIG. 1 shows of an exploded view of an embodiment of the configurable lamp assembly 100 showing the lamp-lens module 120 and the power module 160. The lamp-lens module has a front or first side 122 from which light is emitted. The lamp-lens module back or second side 124 has a portion of the remove-able fastener system 180. The power module 160 has first or front side 162 with a power module connector 166. The power module connector 166 supplies power and control signals to the lamp-PCA connector (not shown) on the lamp-lens module 120 second side 124. The power module second side 164 has an external connector 464 which receives power and control signals from an external source (not shown). While in FIG. 1 the external connector is depicted as a round, sealed connector, other connector types are possible including wire pig tails. At the rear or second side of the power module 160, remove-able fasteners 180 mate with remove-able fasteners 180 on the lamp-lens module 120. In the Figs. the remove-able fasteners 180 are depicted as screws and threaded members. In other embodiments, other types of remove-able fasteners are possible. For example, clips and clamps are a type of remove-able fastener. Note that the concept of remove-able implies that the lamp-lens module is remove-able from the power module even if the fasteners are not remove-able from the modules themselves.

In FIG. 1 when the lamp-lens module 120 connects with the power module 160, the two members capture a gasket 140. This gasket 140 seals the lamp-lens module 120 together with the power module 160, forming an internal common environment 130. This internal common environment 130, is separate from the external ambient environment 135.

Figure 2:
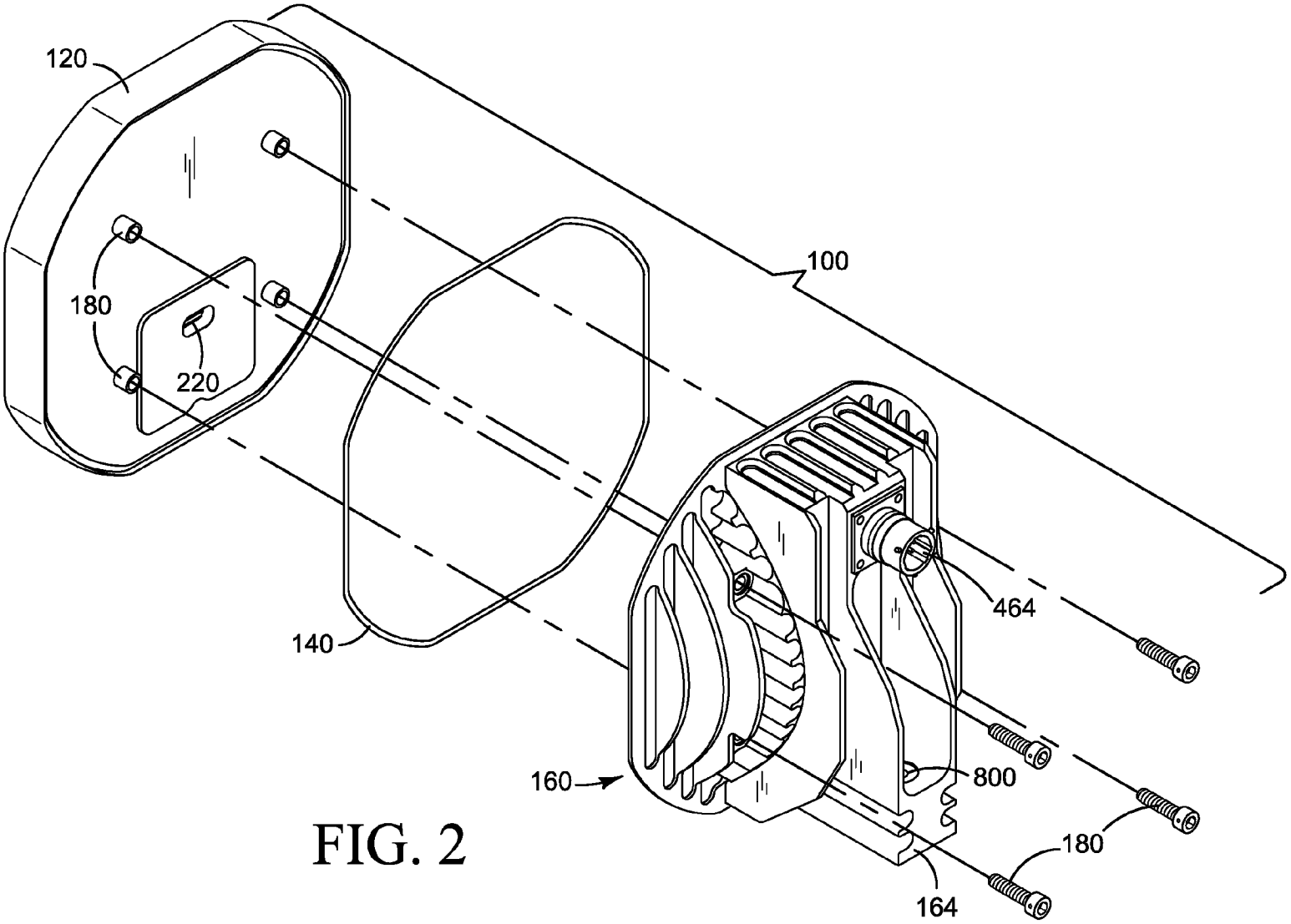
FIG. 2 shows a perspective exploded view of an embodiment of the lamp-lens module and the power module.

FIG. 2 shows a perspective exploded view of the configurable lamp assembly 100 with embodiments of the lamp-lens module 120 and the power module 160. This perspective view shows the lamp-lens PCA connector 220. When the lamp-lens module 120 connects to the power module 160, the lamp-lens PCA connector 220 receives power and control from the power module connector 166 of FIG. 1. The connection of the lamp-lens module 120 with the power module 160 captures the gasket 140. The resulting seal between the lamp-lens module 120 and the power module 160 also protects the electrical connection between the lamp-lens PCA connector 220 and the power module connector 166 of FIG. 1. Another view of the external connector 464 and remove-able fasteners 180 is also shown. The hard point 800 allows the configurable lamp assembly 100 to be mounted to vehicles or stationary platforms (not shown) in a number of ways.

Figure 3:
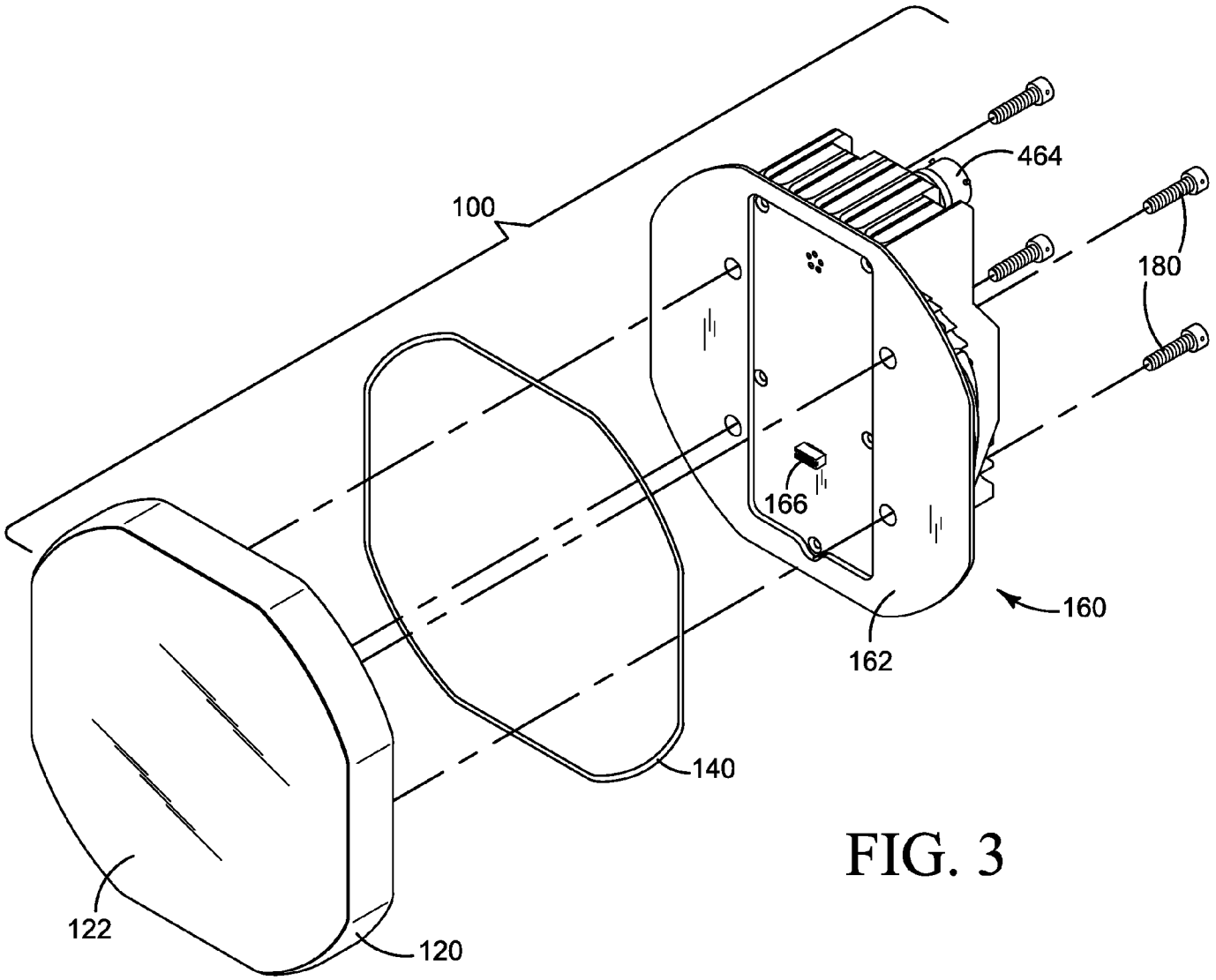
FIG. 3 shows still another exploded view of an embodiment of the lamp-lens module and the power module.

FIG. 3 shows a different perspective exploded view of the configurable lamp assembly 100 with embodiments of the lamp-lens module 120 and the power module 160. This perspective view shows the power module connector 166 located on the power module first side. When the lamp-lens module 120 connects to the power module 160, the lamp-lens PCA connector 220 of FIG. 2 receives power and control from the power module connector 166. The lamp-lens module first side 122, gasket 140, power module first side 162, and external power connector are also shown.

Figure 4:
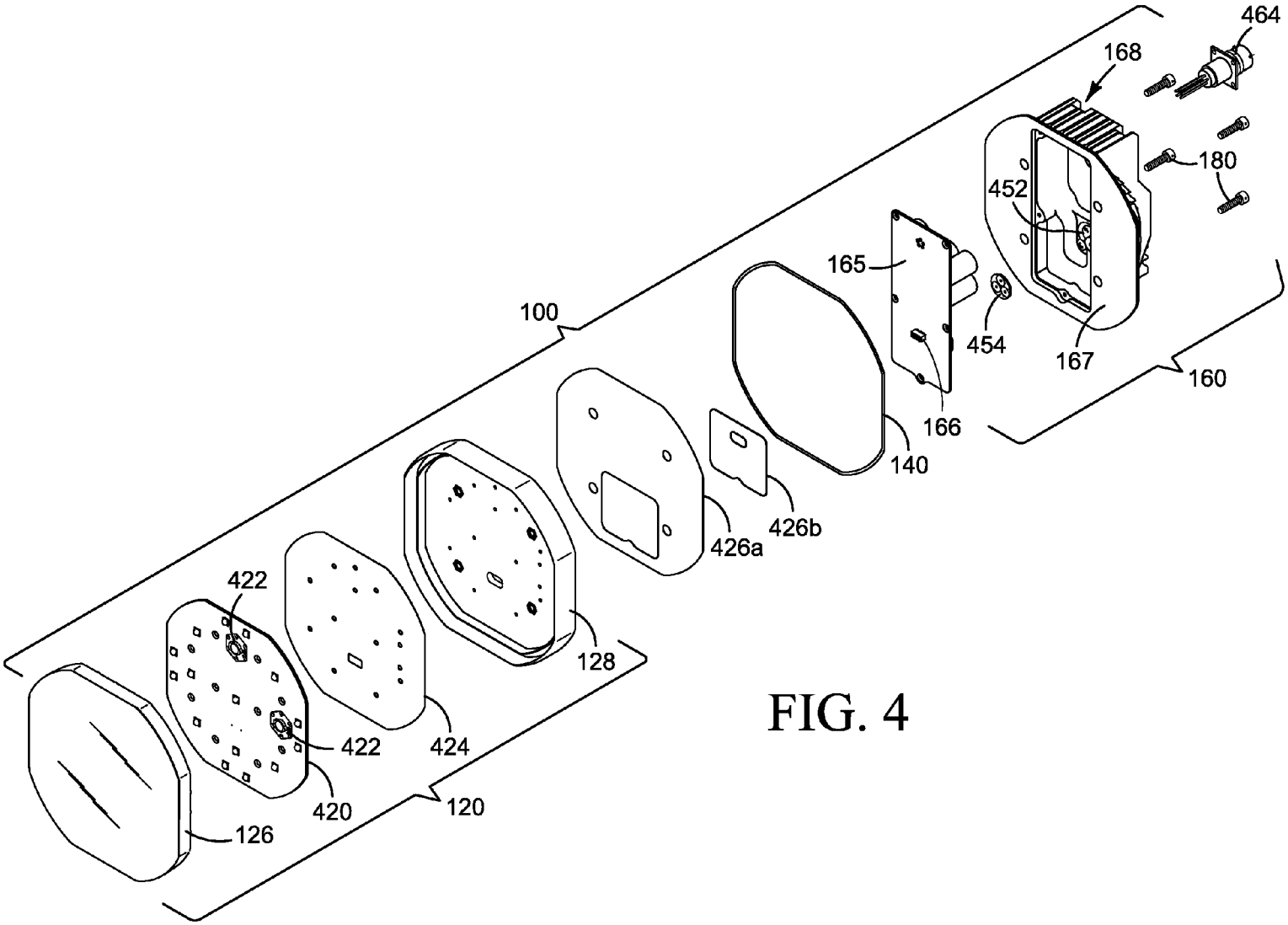
FIG. 4 shows a detailed front perspective exploded view of an embodiment of the configurable lamp assembly.

FIG. 4 shows a detailed front perspective exploded view of an embodiment of the configurable lamp assembly. The lamp-lens module has a lamp housing 128. In one embodiment the lamp housing 128 is a hard plastic or metal and acts as the base for the other components of the lamp-lens module 120. A lamp PCA 420 holds lamps 422 and other electronic components. The term lamps in this disclosure means any number or type of light emitting device, and in particular, LEDs (light emitting diodes). A lamp PCA thermal medium 424 is a paste, gasket or washer type material that aids in the conduction of heat from the lamp PCA 420 to the lamp housing 128. The lamp-lens 126 fits into the lamp housing 128 capturing the lamp PCA 420 and lamp PCA thermal medium 424. The lamp lens 126 is secured to the lamp housing 128 by any of a number of means including adhesives, conformal coatings and encapsulants (not shown). The lamp PCA connector 220 of FIG. 2 mounts to the side of the lamp PCA 420 opposite the lamps 422 and protrudes out the lamp housing 128 for connection with the power module connector 166 of FIG. 3.

The power module heat sink 168 holds a number of components of the power module 160. The power module PCA 165 fits into the power module heat sink first side 167, while the external connector fits into the power module heat sink second side 169 which is shown more completely in FIG. 5. Connections between the external connector 464 and the power module PCA 165 supply power and control signals from external sources to the configurable lamp assembly 100. The power module connector 166 mounts on the side of the power module PCA 165 facing the lamp-lens module 120 for eventual connection with the lamp PCA connector 220 of FIG. 2 An external port 452 connects the power module heat sink first side 167 with the power module heat sink second side 169 of FIG. 5. The advantages of the external port 452 are described in more detail in conjunction with the following Figs.

Gasket 140 and in some embodiments inter-module thermal medium 426*a* or 426*b* seal the lamp-lens module 120 with the power module 160 when the two modules are held together by remove-able fasteners 180. When fastened together, the two modules 120 and 160 have a internal common environment 130 of FIG. 1 which is vented to the external ambient environment of FIG. 1 by the external port 452. A spark arrestor 454 acts to quench any ignition source which might attempt to leave the internal common environment 130 and ignite a flammable external ambient environment 135.

Figure 5:
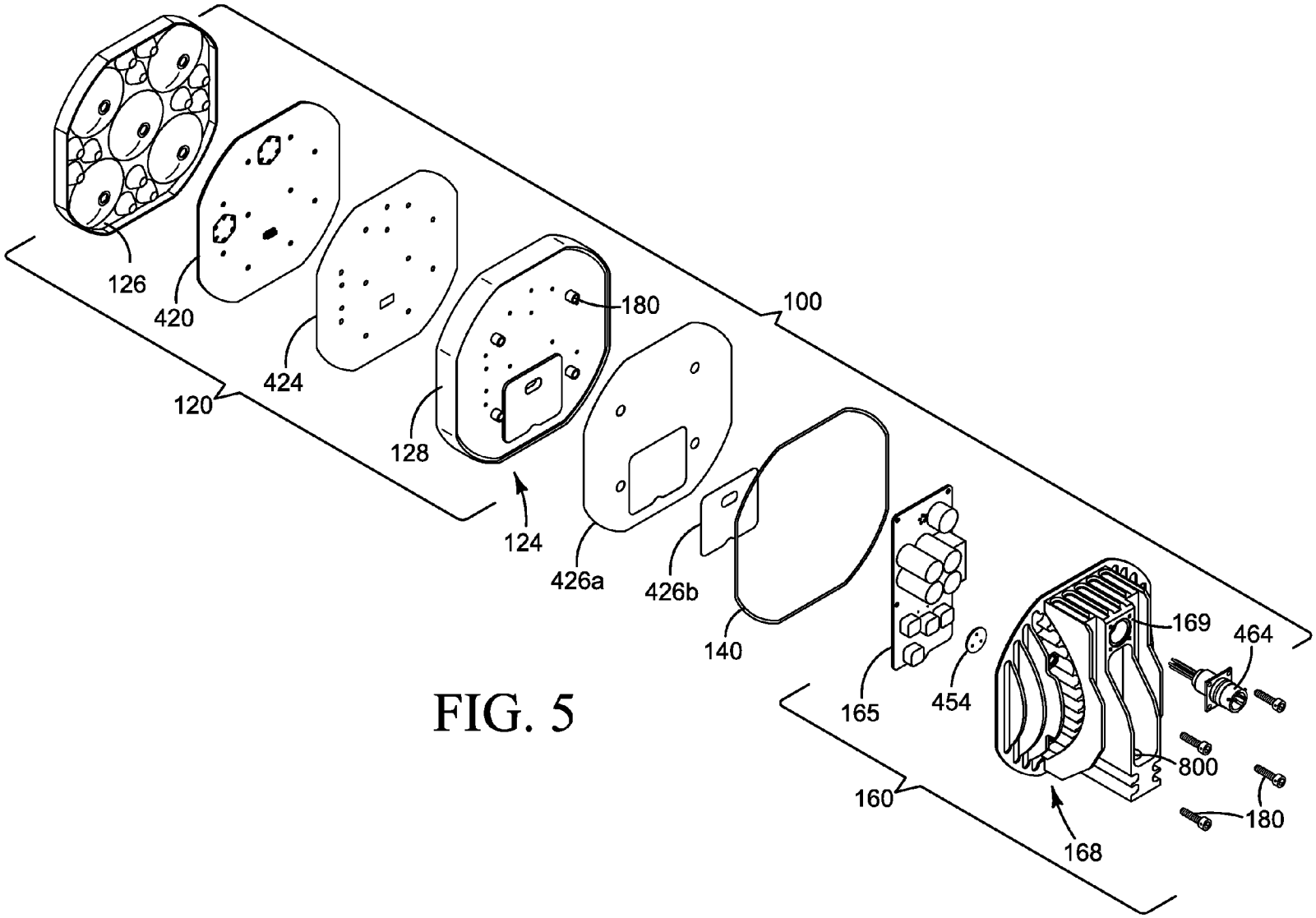
FIG. 5 shows detailed rear perspective exploded view of an embodiment of the configurable lamp assembly.

FIG. 5 shows detailed rear perspective exploded view of an embodiment of the configurable lamp assembly. While similar to the descriptions associated with FIG. 4 earlier, FIG. 5 shows the opposite sites of the components.

Figure 6:
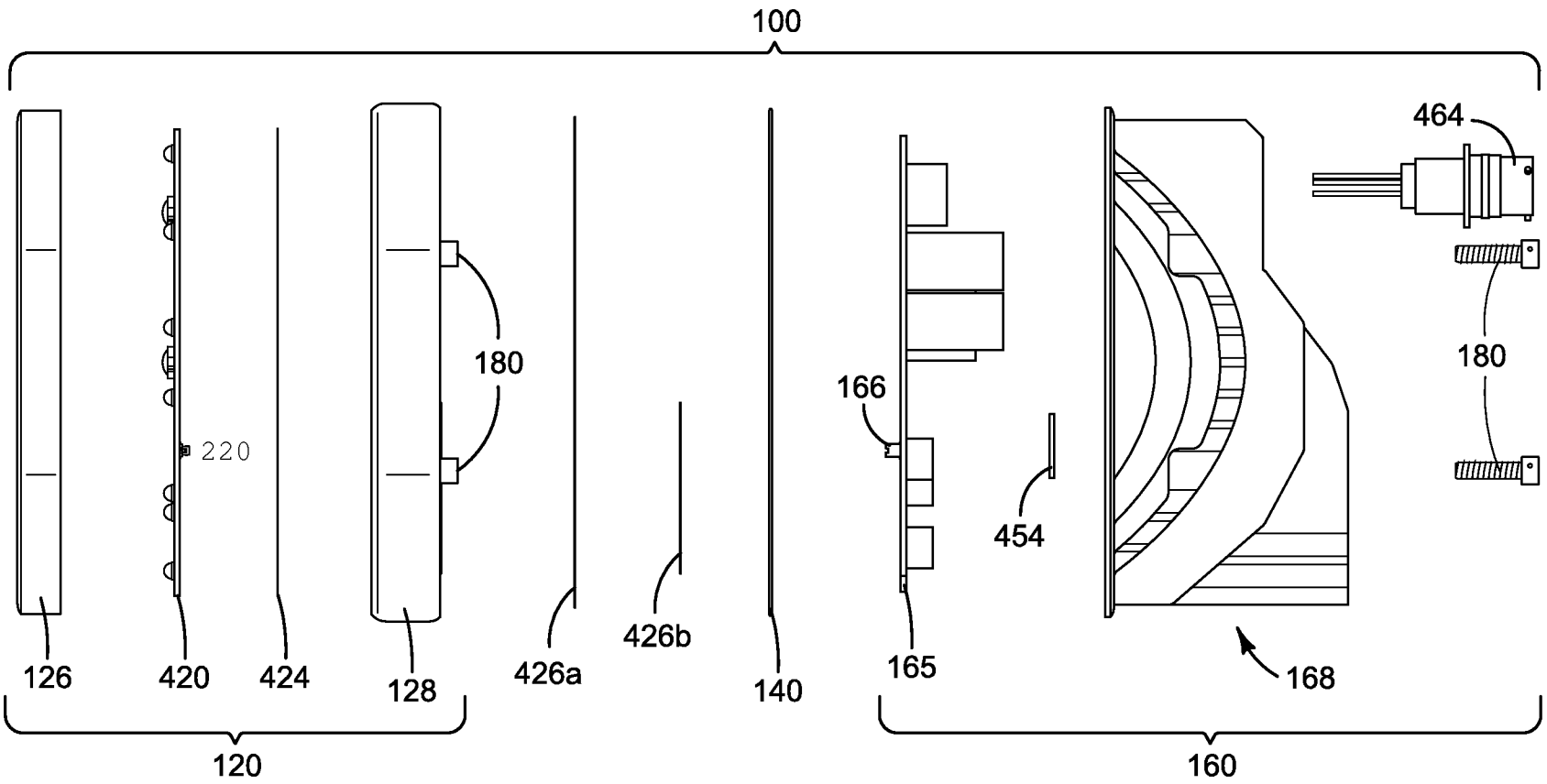
FIG. 6 shows a profile detailed exploded view an embodiment of the configurable lamp assembly.

FIG. 6 shows a profile detailed exploded view an embodiment of the configurable lamp assembly 100. FIG. 6 provides an alternate view of the construction of the lamp-lens module 120 and power module 160 and the gasket 140 and inter-module thermal medium 426*a* and 426*b*. Also more visible in FIG. 6 is the alignment of the lamp PCA connector 220 with the power module connector 166 which make electrical connection when the modules 120 and 160 are assembled together.

Figure 7:
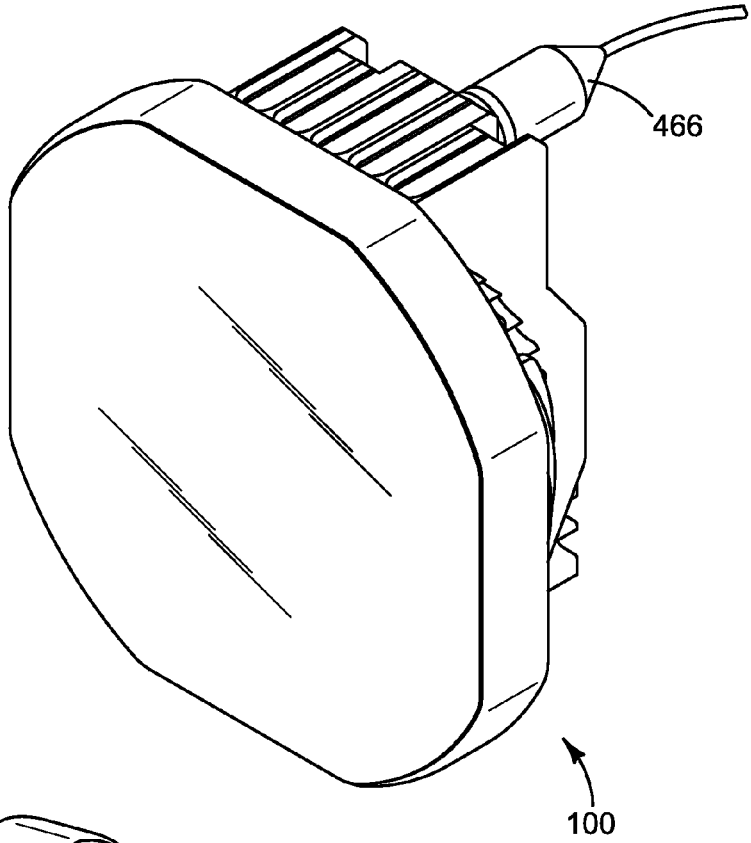
FIG. 7 shows a front perspective view of an embodiment of the configurable lamp assembly.
Figure 8:
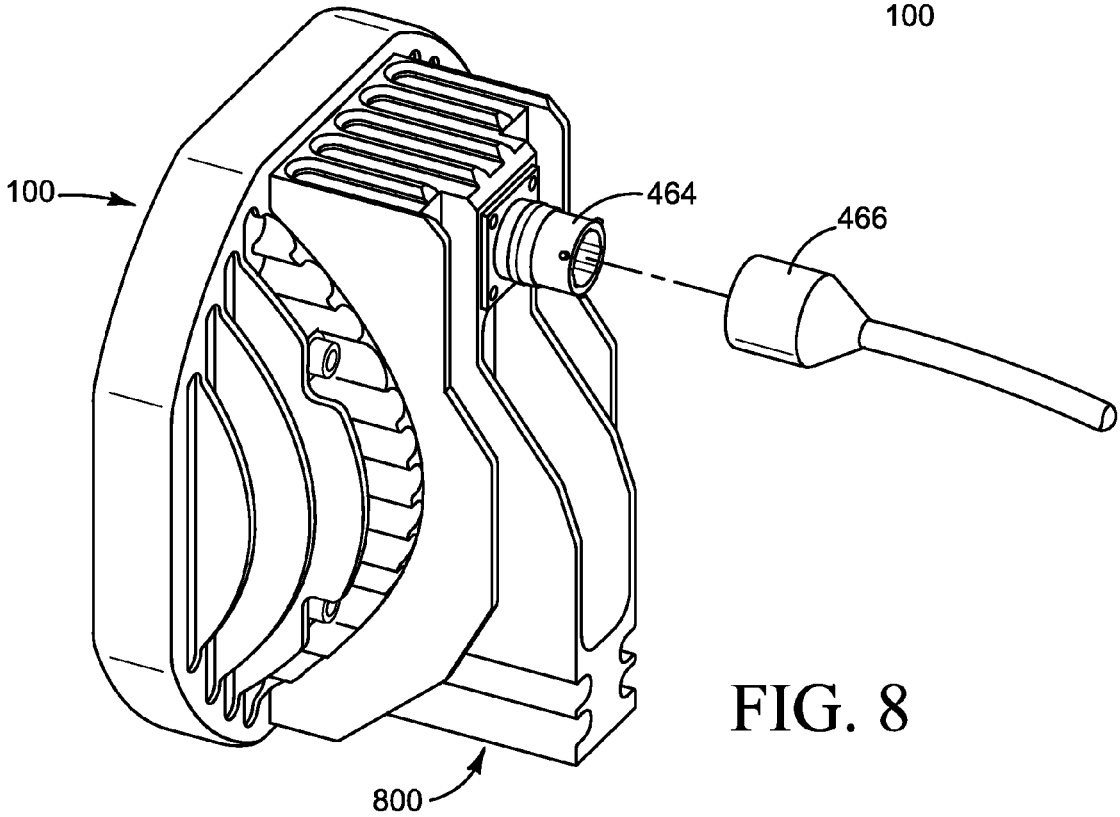
FIG. 8 shows a rear perspective view of an embodiment of the configurable lamp assembly.

FIG. 7 and FIG. 8 show a front perspective view and rear perspective view respectively of an embodiment of the configurable lamp assembly 100. These views show one embodiment of the external connector 464 connected to an external power control source 466. FIG. 8 also indicates the hard point 800 which can support the entire configurable lamp assembly 100 in a variety of applications. Various types of mounting assemblies can mount to the hard point 800 and then be fitted to various types of vehicles.

Figure 9:
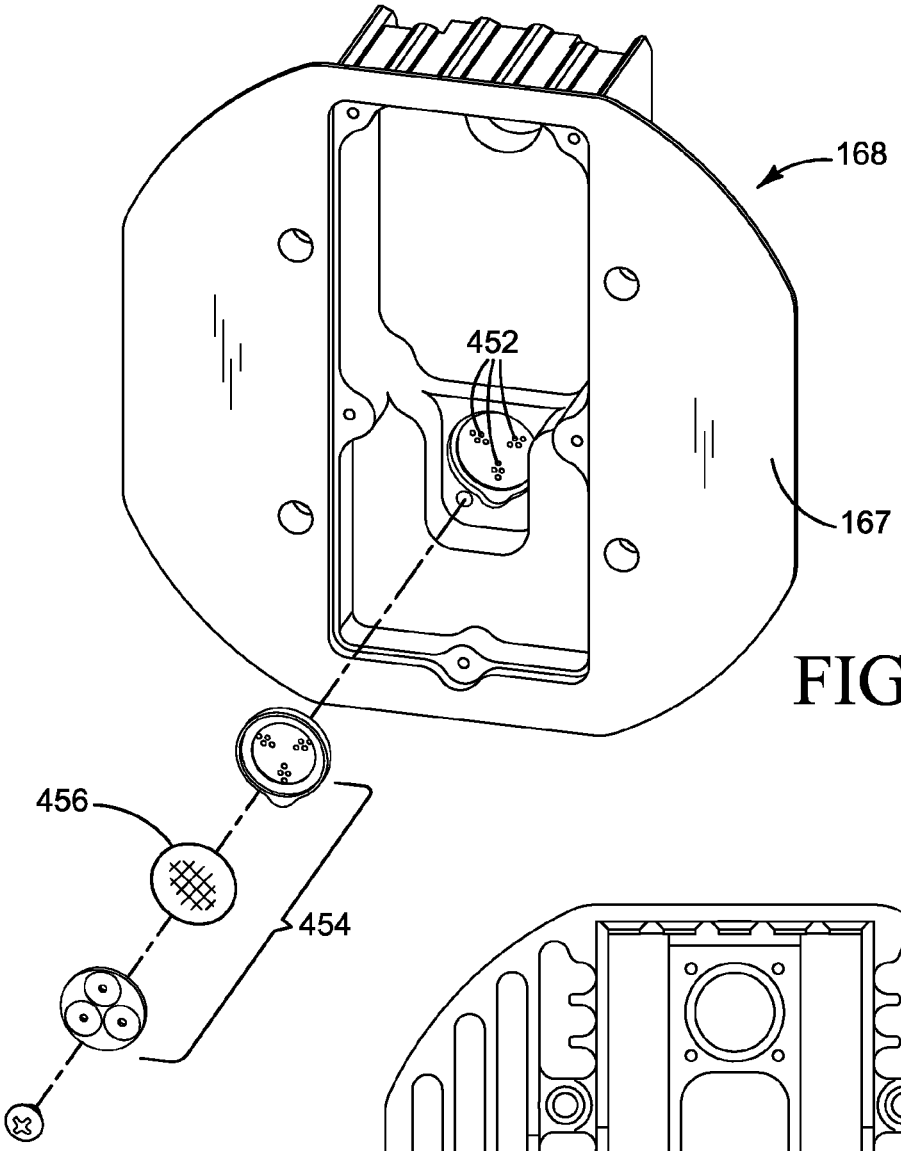
FIG. 9 shows details of an embodiment of the moisture barrier and spark arrestor.
Figure 10:
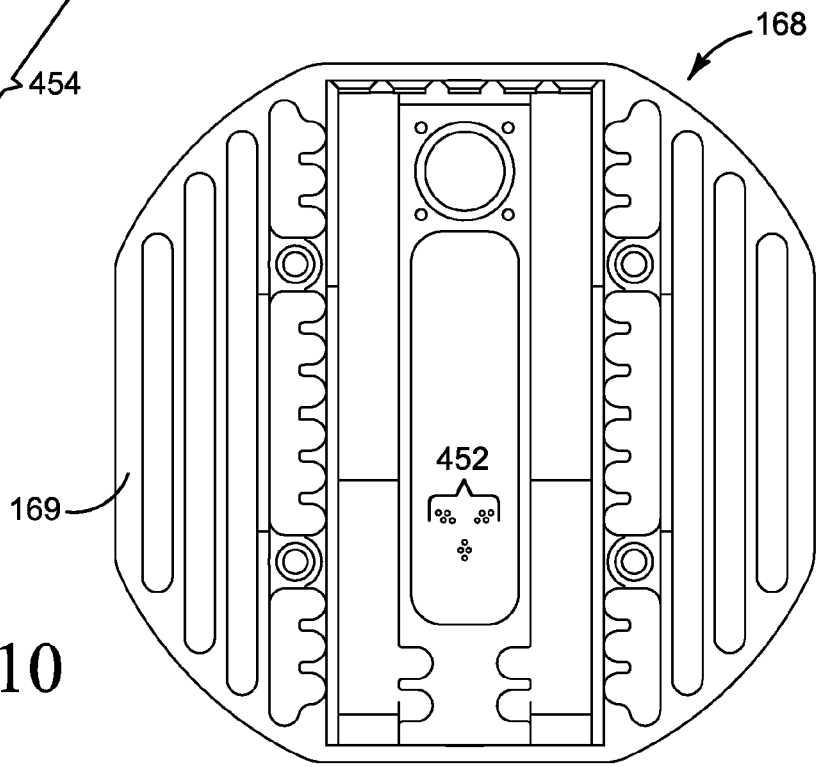
FIG. 10 shows an embodiment of a rear view and vent port detail.

FIG. 9 shows details of an embodiment of the moisture barrier 456 and spark arrestor 454, while FIG. 10 shows an embodiment of a rear view of the external port 452 detail. The external port 452 allows gaseous exchange between the internal common environment 130 with the external ambient environment 135, both of FIG. 1. When the configurable lamp assembly is mounted on a high performance aircraft for example, steep climbs or dives will rapidly change the pressure difference between the internal and external environments. The external port 452 allows this pressure difference to quickly equalize. The spark arrestor 454 acts to prevent an ignition source inside the configurable lamp assembly 100 from reaching the external ambient environment 135. The narrowness of the external port 452 passages also aid in spark arresting. The moisture barrier 456 acts to allow gaseous exchange between the two environments 130 and 135 but reduces or prevents the passage of liquid. The moisture barrier 456 is interposed between the two environments 130 and 135 inside the spark arrestor 454. The moisture barrier 456 can be single or multiple pieces of material and can also be described as a waterproof/breathable fabric. The design and construction of waterproof/breathable fabrics is known to those skilled in the art. When used in conjunction with the spark arrestor 454, the moisture barrier acts to further aid in the arrest of sparks.

Figure 11:
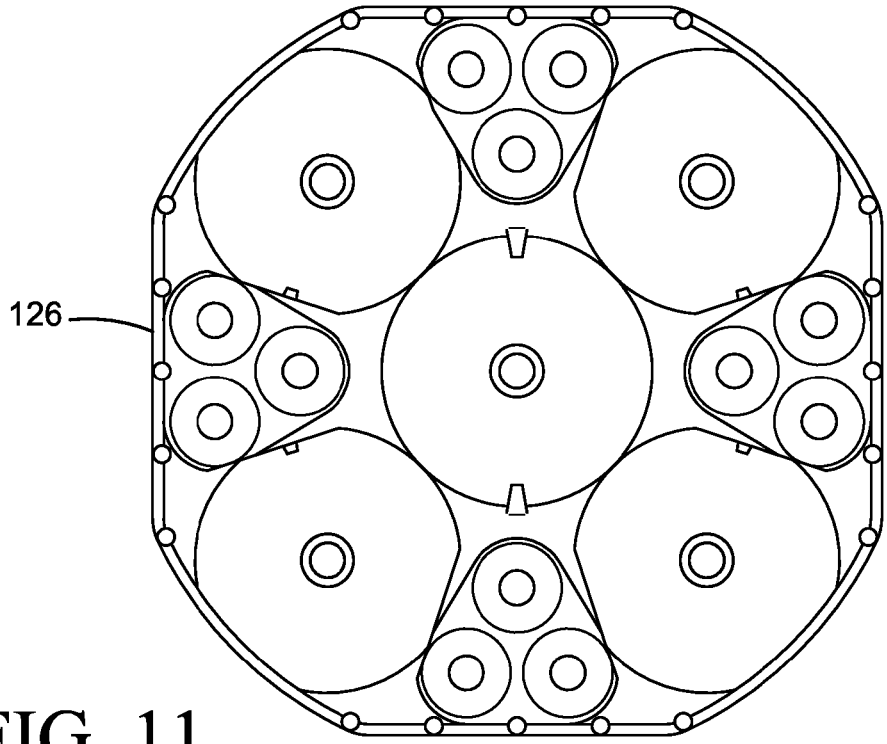
FIG. 11 shows an embodiment of the lens.

FIG. 11 shows an embodiment of the lens 126 which also includes individual reflectors for one or more lamps. The choice of lens type together with reflector combinations can enable a variety of beam profiles. While spot light and flood light beams are well known, other custom lenses can provide custom beam patterns for specific uses.

Figure 12:
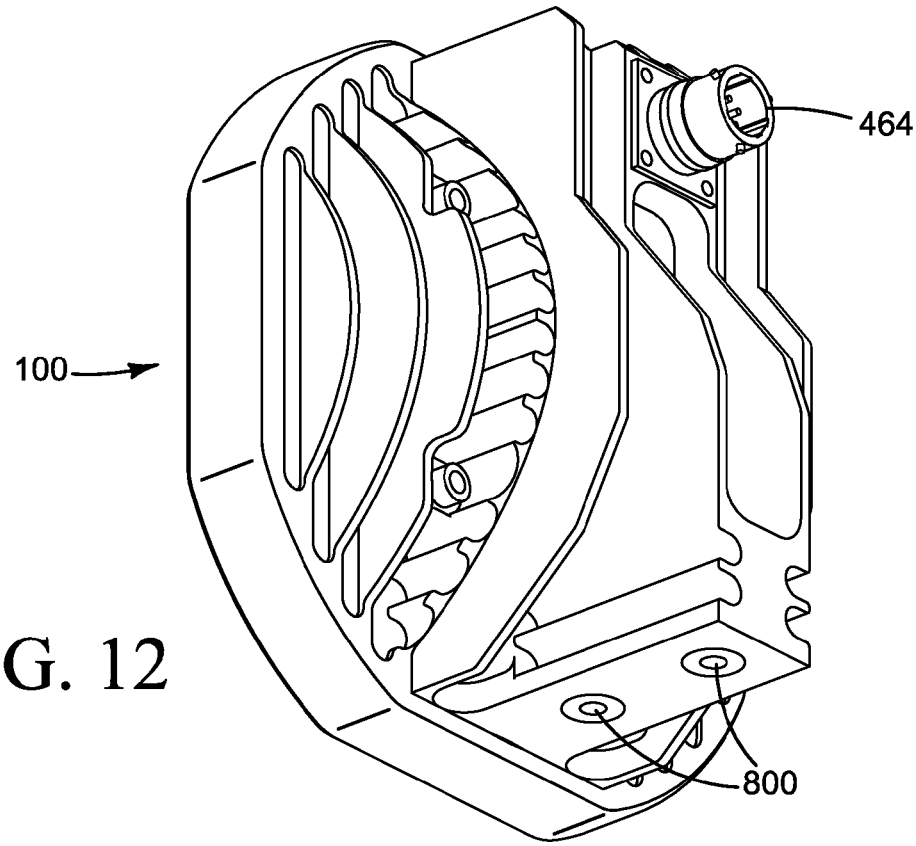
FIG. 12 shows hard points on an embodiment of the configurable lamp assembly.

FIG. 12 shows hard points 800 on an embodiment of the configurable lamp assembly 100. The hard points 800 can be tapped directly into the body of the power module or be inserts. Inserts can be useful when the body of the power module is a softer metal or plastic. The inserts can be a harder material which can withstand repeated assembly and disassembly. While holes with inserts are shown in FIG. 12, the ribs of the power module in FIG. 12 can also be considered as hard point and be adapted for mounting purposes.

Figure 13:
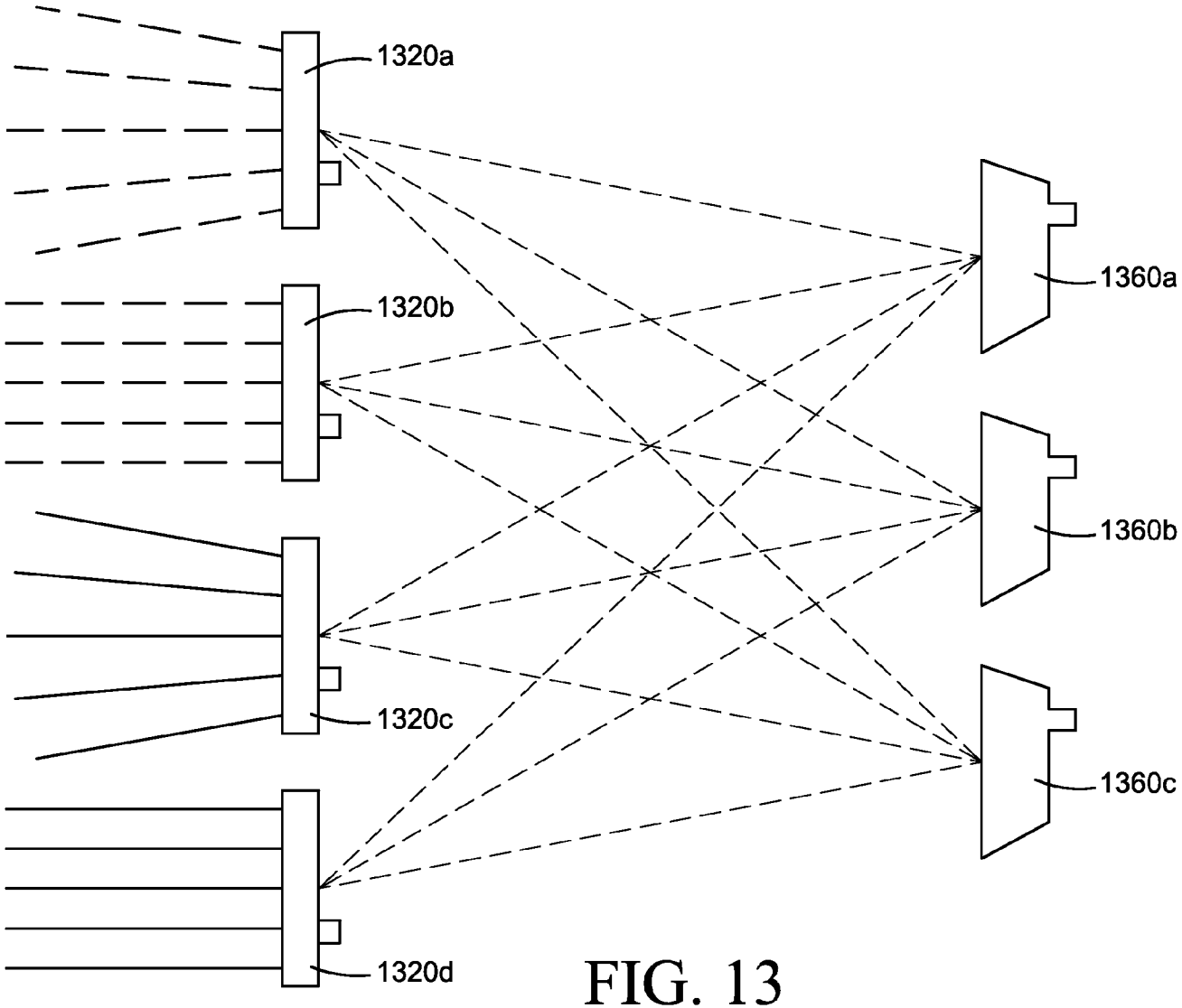
FIG. 13 shows how various embodiments of lamp-lens and power modules can be assembled to form various embodiments of the configurable lamp assembly.

FIG. 13 shows how various embodiments of Lamp-lens modules 1320*a*, 1320*b*, 1320*c*, and 1320*d* and Power Modules 1360*a*, 1360*b*, and 1360*c* can be assembled to form various embodiments of the configurable lamp assembly 100. Lamp-lens module 1320*a* represents a lamp-lens module with a flood light dispersion beam of infrared light as indicated by dashed lines. Lamp-lens module 1320*b* represents a lamp-lens modules with a spot light type beam of infrared light. Lamp-lens module 1320*c* represents a visible flood light indicated by solid lines, while 1320*d* represents a visible spot light. Note that these four lamp-lens module examples represent only a fraction of the possibilities. For example other spectrums, light output levels and dispersions are possible. Combinations of switchable visible and infrared light are also possible for overt/covert applications.

The power modules 1360*a*, 1360*b*, and 1360*c* represent different power modules. For example power module 1360*a* might be for 12 volt DC only, while power module 1360*b* might be for 120 volts AC. Still others might be rated for higher power levels, other voltages, other frequencies or extreme environments and temperatures.

The interchangeability of various lamp-lens modules with various power modules provides the advantage of a modular kit approach. By stocking a limited type of modules, a technician can create numerous versions of configurable lamp assemblies by mixing and matching lamp-lens modules with power modules. Repair material costs can also be reduced when one module can be replaced without scrapping the entire configurable lamp assembly.

Using the examples of FIG. 13, a user provides a lamp-lens module configured to produce a selected light emission pattern, light intensity and a selected spectral emission range. The lamp-lens is chosen from the available choices 1320*a*, 1320*b*, 1320*c* or 1320*d*. The user then provides a power module adapted to a selected range of power inputs. The power module is chosen from the available choices of 1360*a*, 1360*b*, or 1360*c*. The user then interfaces the two modules together to form a completed configurable lamp assembly. The power module transmits power to the lamp-lens assembly, while the venting system allows gaseous venting between the internal common environment inside the assembly and the external ambient environment. The moisture barrier enables the blocking of liquids between the internal environment and the external ambient environment, while the spark arrestor enables the arresting of sparks from passing from the internal environment to the external environment.

The user can then attach the configurable lamp assembly to a vehicle or stationary site by mounting the configurable lamp assembly to a mounting adapter by the hard points and then to the user application, or mount the assembly directly.

Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

Glossary

| Ref Number | Name |
|---|---|
| 100 | Configurable Aircraft and Vehicle Lamp Assembly |
| 120 | Lamp-lens Module |
| 122 | Lamp-lens Module First Side |
| 124 | Lamp-lens Module Second Side |
| 126 | Lens |
| 128 | Lamp Housing |
| 130 | Common Internal Environment |
| 135 | External Ambient Environment |
| 140 | Gasket |
| 160 | Power Module |
| 162 | Power Module First Side |

-continued

Glossary

| Ref Number | Name |
|---|---|
| 164 | Power Module Second Side |
| 165 | Power Module PCA |
| 166 | Power Module Connector |
| 167 | Power module heat sink first side |
| 168 | Power module heat sink |
| 169 | Power module heat sink second side |
| 180 | Removable Fastener System |
| 220 | Lamp PCA connector |
| 420 | Lamp PCA |
| 422 | Lamp |
| 424 | Lamp PCA thermal Medium |
| 426a | Inter-Module Thermal Medium |
| 426b | |
| 452 | External Port/Vent port |
| 454 | Spare Arrestor |
| 456 | Moisture Barrier |
| 464 | External Connector |
| 466 | External Power/Control Source |
| 800 | Hard Point |
| 1360a | Direct current |
| 1360b | Alternating Current |
| 1320b, d | Spot light Beam |
| 1320a, c | Flood Light Beam |
| 1320c, d | Visible Light/Lamp |
| 1320a, b | Infrared Light/Lamp |

We claim:

1. A configurable lamp assembly comprising:

a lamp-lens module having a first side and a second side, the first side comprising a lens to direct light from a lamp, the second side comprising a lamp PCA connector;

a power-module having a first side and a second side, the first side comprising a power module connector adapted to connect to the lamp PCA connector;

the second side comprising an external connector, the external connector adapted to connect to an external power source;

a gasket adapted to fit between the lamp-lens second side and the power module first side, the gasket adapted to seal the lamp-lens module and the power module together forming a internal common environment;

an external port connecting the internal common environment with an external ambient environment;

a moisture barrier adapted to permit gaseous communication between the internal common environment, and the outside ambient environment while preventing liquid exchange; and a removable fastener system adapted to hold the lamp lens module together with the power module, capturing the gasket between the lamp lens module and the power module, the removable fastener system enabling interchangeability of the lamp-lens module with the power module.

2. The configurable lamp assembly of claim 1 further comprising an inter-module thermal-medium between the lamp-lens module second side and the power module first side to conduct heat from the lamp-lens-module to the power module.

3. The configurable lamp assembly of claim 1 further comprising a plurality of lamps, some lamps adapted to emit visible light, other lamps adapted to emit infrared light.

4. The configurable lamp assembly of claim 1 further comprising a hard point on the power module for mounting the lighting assembly to vehicles.

5. The configurable lamp assembly of claim 1 wherein the lamp-lens module is configured to project a spot light beam.

6. The configurable lamp assembly of claim 1 wherein the Lamp-Lens module is configured to project a flood light beam.

7. The configurable lamp assembly of claim 2 wherein the inter-module thermal-medium acts to further seal the internal common environment from the external ambient environment.

8. The configurable lamp assembly of claim 1 further comprising a mounting assembly adapted to attach the power-module to a vehicle.

9. The configurable lamp assembly of claim 1 further comprising a spark arrestor at the external port.

10. A configurable lamp assembly comprising:

a lamp-lens module, the lamp-lens module comprising:

a lamp housing;

a lamp mounted on a lamp PCA, the lamp PCA fitted into the lamp housing;

a lamp PCA thermal medium interposed between the lamp PCA and the lamp housing; and a lens fitted to the lamp housing, the lens adapted to permit light from the lamp to exit a first side of the lamp-lens module;

the lamp housing opposite the lens being a second side of the lamp-lens module; and a lamp PCA connector connected to the lamp PCA, the lamp PCA connector exposed on the second side of the lamp lens module;

a power-module comprising:

a power module heat sink, the power module heat sink having a first side and a second side;

a power module PCA attached to the power module heat sink first side;

a power-module-connector attached to the power module PCA, the power module connector exposed on the power module heat sink first side, the power module connector adapted to connect with the lamp PCA connector;

an external connector connected to the power module PCA, the external connector exposed on power module heat sink second side;

an external port connecting the power module heat sink first side and second side;

the power module first side further adapted to receive the lamp lens module second side enabling a gaseous seal between the lamp-lens module and the power module and the connection of the lamp PCA connector to the power module connector;

a gasket adapted to fit between the lamp-lens module second side and power module first side, the gasket adapted to seal the lamp-lens module and the power module together forming an internal common environment;

a moisture-barrier located at the external port of the power module heat sink, the moisture barrier adapted to permit gaseous communication between the internal common environment, and an external ambient environment while preventing liquid exchange; and a removable fastener system adapted to hold the lamp-lens module together with the power module, capturing the gasket between the lamp-lens module and the power module, the removable fastener system enabling a variety of lamp-lens modules to attach to a variety of power modules.

11. The configurable lamp assembly of claim 10 further comprising an inter-module thermal-medium between the lamp-lens-module second side and the power module first side to conduct heat from the lamp-lens-module to the power module.

12. The configurable lamp assembly of claim 10 wherein the lamp emits primarily visible light.

13. The configurable lamp assembly of claim 10 wherein the lamp emits primarily infrared light.

14. The configurable lamp assembly of claim 10 further comprising a plurality of lamps some lamps adapted to emit visible light, other lamps adapted to emit infrared light.

15. The configurable lamp assembly of claim 10 further comprising a hard point on the power module for mounting the configurable lamp assembly to vehicles.

16. The configurable lamp assembly of claim 10 wherein the lamp-Lens module is configured to project a spot light beam.

17. The configurable lamp assembly of claim 10 wherein the lamp-Lens module is configured to project a flood light beam.

18. The configurable lamp assembly of claim 10 further comprising a spark arrestor at the external port.

19. A method of constructing a configurable lamp assembly, the method comprising:

providing a selection of lamp-lens modules, each lamp-lens module configured to produce a selected light emission pattern and a selected spectral emission range;

providing a selection of power modules each power module adapted to a selected range of power inputs;

remove-ably interfacing together one of the selection of lamp lens modules with one of the selection of power modules to form a configured lamp assembly with a internal common environment;

transmitting electrical power from the power module to the lamp-lens assembly;

venting gasses between internal common environment and an external ambient environment;

blocking the passage of liquids between the internal common environment and the external ambient environment; and arresting sparks from passing from the internal common environment to the external environment.

* * * * *